United States Patent [19]

Seefeldt

[11] Patent Number: 4,545,715

[45] Date of Patent: Oct. 8, 1985

[54] PROCESS AND APPARATUS FOR TRANSPORTING PILES OF SHEETS

[75] Inventor: Joachim Seefeldt, Neuffen, Fed. Rep. of Germany

[73] Assignee: Bielomatik Leuze GmbH & Co., Fed. Rep. of Germany

[21] Appl. No.: 497,134

[22] Filed: May 23, 1983

[30] Foreign Application Priority Data

May 28, 1982 [DE] Fed. Rep. of Germany ..... 3220095

[51] Int. Cl.[4] ..... B65H 31/30

[52] U.S. Cl. ..... 414/36; 198/457; 198/627; 198/468.2; 271/85; 414/43; 414/52; 414/69; 414/86; 414/786

[58] Field of Search ..... 414/28, 36, 43, 48, 414/49, 52, 69, 86, 786; 271/84, 85, 221; 198/457, 486, 604, 627

[56] References Cited

U.S. PATENT DOCUMENTS

| | | | |
|---|---|---|---|
| 3,199,653 | 10/1965 | McGowan | 271/85 X |
| 3,729,190 | 4/1973 | Harris et al. | 414/69 X |
| 3,747,920 | 7/1973 | Linkus | 271/85 |
| 3,891,204 | 6/1975 | Mager | 414/69 X |
| 4,055,261 | 10/1977 | Schneider | 271/84 X |
| 4,203,694 | 5/1980 | James | 414/28 |
| 4,297,066 | 10/1981 | Ramcke et al. | 271/218 X |
| 4,403,899 | 9/1983 | Lampe et al. | 198/627 X |

*Primary Examiner*—Leslie J. Paperner

*Attorney, Agent, or Firm*—Steele, Gould & Fried

[57] ABSTRACT

A process and apparatus forms and removes piles of sheets transported along a horizontal transport path to a lower-lying transverse removal path in which a pair of removal conveyors engage the end faces of the pile. The removal conveyors are spaced to substantially correspond to the length of the pile, for engaging the edges of the pile during removal transverse to the transport path. A gripper is mounted to move along the higher-lying feed transport path and to engage the leading edge of the pile. The gripper moves along the transport path until the trailing edge of the pile falls onto the removal path, whereupon the pile becomes shortened in the transport direction, i.e., between the removal conveyors in the direction transverse to the removal path, due to curvature of the pile. The gripper is than opened to let the leading edge of the pile fall onto the removal path as well, whereupon the pile assumes its full length, the edges of the pile being substantially in surface engagement with the removal conveyors.

5 Claims, 3 Drawing Figures

PROCESS AND APPARATUS FOR TRANSPORTING PILES OF SHEETS

BACKGROUND OF THE INVENTION

1. Field of the Invention

The invention relates to a process and an apparatus for the removal of piles of sheets. 2. Prior Art In the manufacture of piles of sheets, for example paper, which are also denoted reams, such sites are generally tranversely moved away from the actual preparation line and are then temporarily stored or packaged. Known apparatus for effecting this do not always function satisfactorily.

SUMMARY OF THE INVENTION

It is an object of the invention to create an improved process and apparatus for removal of such types of sheet piles from a sheet pile preparation line.

In accordance with the invention, in a process in which a formed pile of sheets is transported out of a sheet preparation machine, the pile is first grasped by a gripper at the front pile end (leading edge), for example while it is located on a horizontal table, and is then pulled across a removal path which lies at a lower level than the table. When the rear end or trailing edge of the pile clears the table, it drops on to the lower removal path and at this point assumes or falls into an essentially S-shaped curvature. The gripper then opens, once the pile front edge has reached the end of the removal path, and for example by means of an end stop arranged there, the pile is then held back while the gripper is moved further, thus enabling the pile to fall with its front edge on to the removal path.

The individual sheets of the pile are, on the curvature of the pile and the subsequent falling down, somewhat moved relative to one another, so that any interference of the individual sheet edges generated by guillotining processes, which in subsequent treatment, particularly automatic sheet removal, could lead to difficulty, is avoided. Any steps visible along the profile of the pile from section-wise cutting processes also become invisible, and the whole pile is blocked up. The front and rear limits in the feed transport direction (which are the lateral ones in the removal transport direction) of the removal path preferably consist of a removal feeder in the form of a belt or roller conveyor which engages the end face of the pile of sheets and thus transports it away on a removal table, which is preferably provided with a high sliding surface. Preferably at least one of such belt or roller conveyors is movable, preferably swivelably mounted, in order to assure proper engagement with the end face of the pile and to effect the desired transport thereof. On falling down into the pile and during the removal, an additional evening out action is effected on the sheet pile.

The device for transporting away sheet piles in accordance with the invention thus has an advantageously essentially horizontal flat feed transport path to which a lower lying removal path connects with a removal conveyor working transversely to the feed transport direction. It furthermore has a gripper working longitudinally of the feed path, which grips the feed edge of the pile, the working region of which extends up to over the removal path, wherein the removal path preferably has lateral limits constructed as a belt or roller removal conveyor, the spacing of which essentially corresponds to the length of the pile.

BRIEF DESCRIPTION OF THE DRAWINGS

An exemplary embodiment of the invention is illustrated in the accompanying drawings, wherein.

DETAILED DESCRIPTION OF THE PREFERRED EMBODIMENTS

Figure 1:
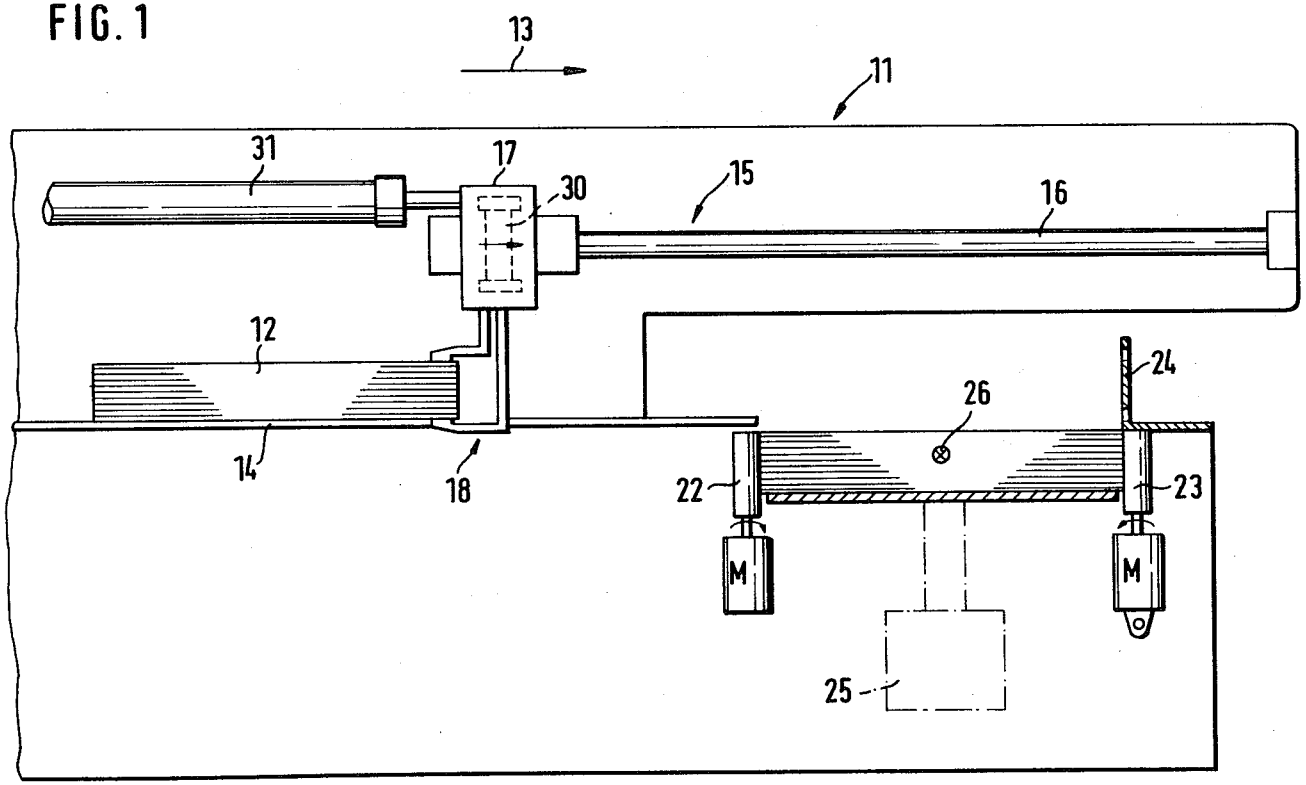
FIGS. 1 to 3 show in schematic longitudinal section three working positions of the same apparatus in accordance with the invention.

The drawings show the rear end of a paper converting or processing machine 11, in which for example paper sheets cut from paper rolls are collected to form sheet piles 12 which are then transported in a feed transport direction 13. The sheet pile 12 runs on a feed transport table 14 over which a gripper transport device 15 is arranged which consists of guide rods 16 and a gripper head 17 horizontally movable thereon, e.g. by means of a pneumatic cylinder 31, on which jaw-like grippers 18 are arranged. Grippers 18 can be opened and closed by a pneumatic cylinder 30 or by a mechanical mechanism controlled by cams arranged in the gripper head 17.

The gripper transport device 15 extends over a lower section of the feed transport table and across a removal transport path 20, which, relative to the feed transport table 14 is arranged sunken at least by about the height of a sheet pile 12. The removal path 20 consists of a removal table 21 which, by appropriate profiling, coating or similar measures, is very slippery. At its front and rear end in the transport direction 13 there is arranged in each case a driven belt or roller conveyor 22, 23, driven by motors M, which by application to the face of the sheet pile can transport a sheet pile lying on the removal table 21 transversely to the feed transport direction 13, i.e. perpendicular to the plane of the drawing.

A stop 24 is provided at the front end of the removal path 20, above the height of the feed table 14. Stop 24 has apertures through which a gripper 18 (normally several are provided in the transverse direction) can pass.

It should be noted that in the case that several piles of sheets coming on the feed transport table should be collected one above the other in the removal path, the removal transport table 21 can be mounted for vertical movement by means of a suitable lowering device 25 illustrated in dashed lines, the conveyor belts 22, 23 being be constructed wider.

The mode of operation is as follows:

In FIG. 1 the sheet pile 12, fed on the feed transport table 14 in the feed transport direction 13, is grasped by grippers 18 at its front end or leading edge from below and above and pulled over the remainder of the feed transport table in the direction towards the removal path. This is happening while the removal of the previous pile perpendicular to the plane of the drawing is taking place (indicated by the arrow 26 seen from behind the counter-running turning of the belt conveyors 22, 23). The removal is finished and the removal path 20 free when the gripper has over-run the removal path to such an extent that by flexure, the sheet pile extends into the removal path.

Figure 2:
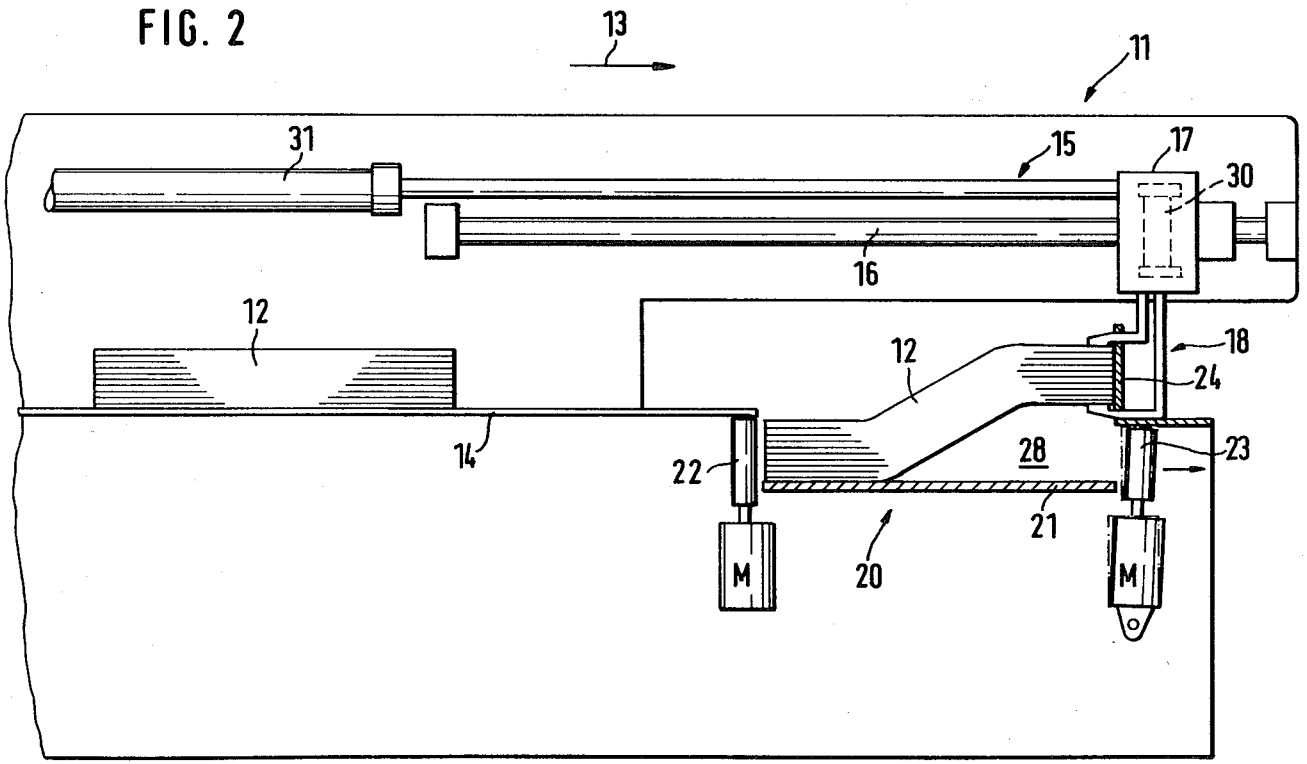

In the position illustrated in FIG. 2 the sheet pile has reached the stop 24 where simultaneously the grippers 18 are opened above and below. The pile of sheets has already been somewhat shortened in its length by the bowing or curvature it has acquired, falling with its rear or trailing edge into the channel formed by the removal path 20, so that it forms itself into an S-shape. By means of the opening and further pulling back of the grippers, the front end of the pile is then released and it falls likewise into the channel 28 formed by the removal path. Thereby a loosening up and knocking straight of the pile takes place. This is promoted by one of the conveyor belts 23 forming one of the two limits of the channel 28 swinging slightly outwardly, to increase the channel width.

Figure 3:
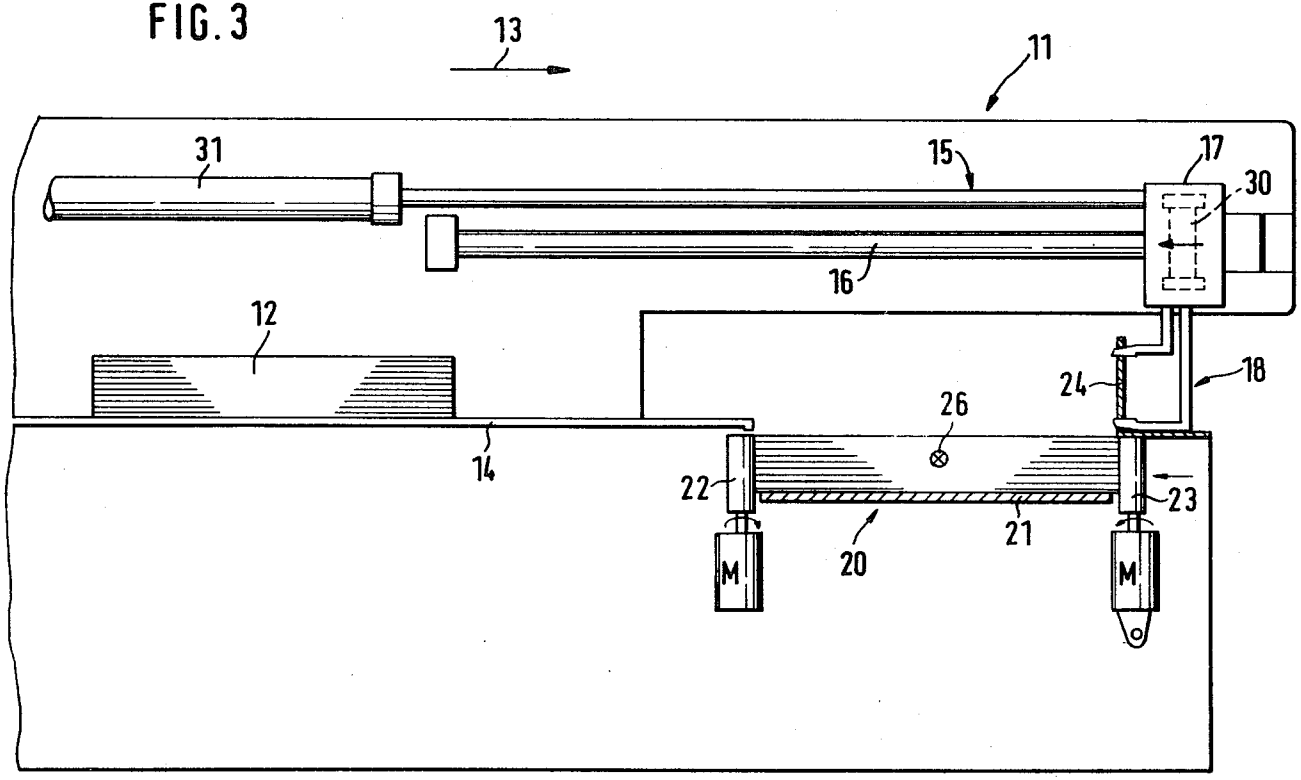

In FIG. 3 the conveyor belt 23 has swung back again so that belts 22 and 23 lie against two oppositely lying end faces of the pile of sheets 20. The pile is thus knocked straight and transverse removal transport can then begin in the direction of the arrow 26 seen from behind. The gripper head 17 with the grippers 18 can immediately begin its return path counter to the feed transport direction 13, wherein it runs along a path over the removed pile of sheets. Accordingly it is possble to remove the piles of sheets almost without gaps, since the feed away time can already be used in order to guide the grippers again into their gripping position according to FIG. 1 and then further up to shortly before the position shown in FIG. 2.

In place of the end face conveyors 22, 23 illustrated, other conveying means can also be used in the region of the removal path.

I claim:

1. In a process for removing piles of sheets transported in a first direction by an apparatus producing such piles, the first direction defining leading and trailing ends for each pile, the improvement comprising the steps of:

successively gripping each pile of sheets at the leading end thereof in said first direction;

pulling the gripped pile in the first direction over a lower-lying removal path having lateral edges formed by movable members between which the pile must fit with the leading and trailing ends substantially in surface engagement with the lateral edges;

reducing the length of the pile in the first direction by allowing the trailing end of the pile of sheets to fall freely onto the lower-removal path and thereby assume a curved form;

straightening the pile by ungripping the leading end of the pile and allowing the leading end to all freely onto the lower-lying removal path, the pile assuming its full length with the leading and trailing ends substantially in surface engagement with the lateral edges; and, transporting the pile of sheets away on the removal path in a direction transverse to the first direction by operating the movable members while in surface engagement with the leading and trailing ends of the sheet pile.

2. The process of claim 1, comprising the step of reciprocating a gripper along and counter to the first direction, moving the gripper in the direction counter to the first direction during transportation of the pile on the removal path.

3. An aparatus for removing piles of sheets transported along a substantially horizontal flat feed transport path, the feed transport path defining leading and trailing ends for each pile, the apparatus comprising:

a removal path disposed adjacent to, at a lower level than and transversely of the feed transport path;

a pair of removal conveyors for piles on the removal path, the removal conveyors forming lateral boundaries for the removal path separated by a distance such that the leading and trailing edges are substantially in surface engagement with both removal conveyors when the piles lie flat on the removal path;

a gripper mounted for reciprocating movement along the feed transport path and adapted to grip the leading end of a pile, the gripper reciprocating in a working region extending above the feed transport path and over the removal path; and, means for opening and closing the gripper, keeping the gripper closed when the trailing edge of the pile falls from the transport path thereby forming an S-curve in the pile which shortens its length in the transport direction, and then opening the gripper to let the front edge fall onto the removal path, the pile assuming its full length, lying on the removal path with the leading and trailing ends substantially in surface engagement with the removal conveyors.

4. The apparatus of claim 3, wherein at least one of the removal conveyors is movably mounted to enable the distance between the pair of removal conveyors to be varied for straightening the piles.

5. The apparatus of claim 3, further comprising a removal table forming a floor for the removal path; and, means for raising and lowering the removal table.

* * * * *